US008366019B2

(12) United States Patent
Lee

(10) Patent No.: US 8,366,019 B2
(45) Date of Patent: Feb. 5, 2013

(54) FAUCET EXTENDER

(75) Inventor: Susanna Lee, Alamo, CA (US)

(73) Assignee: Peachy LLC, Alamo, CA (US)

( * ) Notice: Subject to any disclaimer, the term of this patent is extended or adjusted under 35 U.S.C. 154(b) by 0 days.

(21) Appl. No.: 13/430,584

(22) Filed: Mar. 26, 2012

(65) Prior Publication Data

US 2012/0180893 A1 Jul. 19, 2012

Related U.S. Application Data

(63) Continuation of application No. 13/225,259, filed on Sep. 2, 2011.

(60) Provisional application No. 61/381,382, filed on Sep. 9, 2010.

(51) Int. Cl.

| | |
|---|---|
| ***B05B 1/00*** | (2006.01) |
| ***B05B 1/28*** | (2006.01) |
| ***B05B 15/04*** | (2006.01) |
| ***E03C 1/04*** | (2006.01) |
| ***A47K 3/00*** | (2006.01) |

(52) U.S. Cl. ..... 239/211; 239/288.5; 4/678; 4/675; 4/559

(58) Field of Classification Search ..... 239/211, 239/288, 289, 310, 10, 288.3, 288.5; 4/678, 4/661, 675, 559

See application file for complete search history.

(56) References Cited

U.S. PATENT DOCUMENTS

| | | | | |
|---|---|---|---|---|
| 1,067,443 | A | 7/1913 | Schuchart | |
| 1,203,935 | A | 11/1916 | Stringham | |
| 1,430,197 | A | 9/1922 | Sonday | |
| 1,680,333 | A | 8/1928 | Kooperstein | |
| 3,316,928 | A | 5/1967 | Weakley | |
| 3,462,080 | A * | 8/1969 | Demaree et al. | 239/27 |
| 3,847,159 | A | 11/1974 | Hofer | |
| 4,934,597 | A * | 6/1990 | Crutcher | 239/27 |
| 5,125,577 | A * | 6/1992 | Frankel | 239/211 |
| 5,337,956 | A * | 8/1994 | Crutcher | 239/27 |
| 5,480,072 | A | 1/1996 | Ripley | |
| 6,119,286 | A * | 9/2000 | Briscoe | 4/675 |
| 7,588,197 | B2 * | 9/2009 | Finell | 239/289 |
| 7,818,830 | B2 * | 10/2010 | Thorne et al. | 4/675 |
| 2006/0207670 | A1 | 9/2006 | Peters | |
| 2007/0175531 | A1 | 8/2007 | Daniels | |
| 2011/0127301 | A1 | 6/2011 | Weber | |

* cited by examiner

*Primary Examiner* — Len Tran
*Assistant Examiner* — Chee-Chong Lee
(74) *Attorney, Agent, or Firm* — Morgan, Lewis & Bockius LLP

(57) ABSTRACT

A device and method for delivering water to a person who is unable to reach household or other types of water dispensing faucets. In some embodiments, the device comprises a trough for delivering the liquid and an attachment member for attaching the trough to a faucet.

15 Claims, 8 Drawing Sheets

FAUCET EXTENDER

CLAIM OF PRIORITY

This Application is a continuation under 35 U.S.C. §120 of earlier filed U.S. Non-Provisional Application Ser. No. 13/225,259, filed Sep. 2, 2011, by Susanna Lee, which claimed priority under 35 U.S.C. §119(e) from earlier filed U.S. Provisional Application Ser. No. 61/381,382, filed Sep. 9, 2010, by Susanna Lee, both of which are incorporated herein by reference.

BACKGROUND

1. Field of the Invention

The current disclosure relates to faucet attachments generally and specifically to faucet attachments used to enable people to effectively gain access to water that would otherwise be beyond their arm reach.

2. Background

When children are young it is common for parents to assist their children in reaching water faucets. Like adults, children need to wash their hands, gain access to drinking water, or access tap water for countless other reasons. Unlike adults, children have a shorter arm reach which can interfere with the usage of faucets that are generally designed for adult use.

Some methods to solve this problem that have been used include direct parental assistance and the use of foot stools. There are distinct disadvantages to these methods. Adults sometimes are unable or unavailable to assist children, and foot stools require large amounts of floor space.

The problem is not limited to young children. People with disabilities, the elderly, people with dwarfism, people with arthritis or back pain, or other adults may find it difficult to reach the normal water-flow of a faucet. Users may also desire to alter the water-flow from a faucet to more easily water plants, fill a pet's water dish, or for many other reasons.

The solution to this problem is a device that can attach to a faucet and physically bring the water-flow from a faucet closer to the user rather than the user having to come closer to the water-flow.

DETAILED DESCRIPTION

Figure 1:
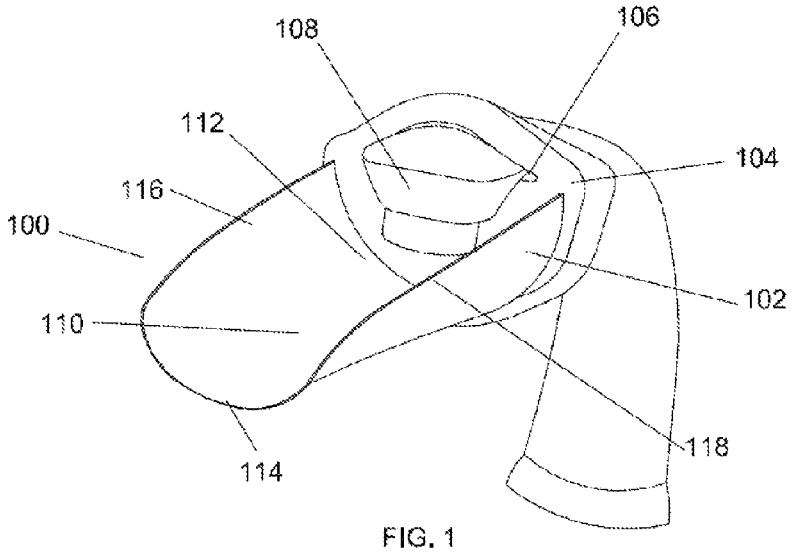
FIG. 1 depicts an embodiment of a faucet attachment device.

FIG. 1 depicts an embodiment of a faucet attachment device 100. The faucet attachment device 100 can comprise a trough member 102 coupled with an attachment member 104. The trough member 102 can comprise a channel 110 and channel walls 116 118 running along the longitudinal edges of the channel 110. The channel 110 can be partially open. The channel 110 can comprise an entrance 112 at one end, and an exit 114 at the opposing end. The entrance 112 can be narrowly formed or broadly formed depending on the desired application. The exit 114 can also be narrowly formed or broadly formed depending on the desired application. Some embodiments can comprise a tapered channel 110. The tapering of the channel 110 can occur in either direction from the entrance 112 to the exit 114. By way of a non-limiting example, in some embodiments the channel 110 can be tapered from a broadly formed entrance 112 toward a narrowly formed exit 114. The channel 110 and the trough 102 can be any desired length.

In some embodiments, the channel walls 116 118 can be extensions of the channel 110 along the edges of the channel 100, and can have a variety of shapes and sizes. In the embodiment shown in FIG. 1, the channel walls 116 118 can be curved extensions of the channel 110, such that a transverse cross section of the channel 110 and the channel walls 116 118 can be substantially a "U" shape. In alternate embodiments, the channel walls 116 118 can be separate components that can be coupled with the channel with glue, adhesives, tape, cement, screws, bolts, rivets, anchors, clips, brads, staples, or any other known or desired affixing mechanism. The channel walls can be straight, curved, wavy, thick, thin, flat, short, tall, or have any other desired characteristic. In some embodiments, the trough member 102 can be made of polypropylene, polyethylene, polyurethane, thermoplastic rubber, bamboo, recycled plastic, metal, or any other material or combination of materials that provides the desired strength, flexibility, durability, weight, water resistance, or other desired physical characteristic.

The attachment member 104 can comprise an attachment opening 106. The attachment opening 106 can be configured to engage a faucet 108. In some embodiments, the attachment opening 106 can be substantially the size of a transverse cross-section of a faucet arm. In alternate embodiments, the attachment opening 106 can be circular, semi-circular, square, oval, wider horizontally than vertically, or have any other size or shape. In some embodiments, the attachment member 104 can be made of polypropylene, polyethylene, polyurethane, thermoplastic rubber, bamboo, recycled plastic, metal, or any other material or combination of materials that provides the desired strength, flexibility, durability, weight, water resistance, or other desired physical characteristic. In some embodiments the attachment member 104 can be primarily comprised of one material. In alternate embodiments, the attachment member 104 can be comprised of a different, more flexible, material in the area surrounding the attachment opening 106. In some embodiments, the entire attachment member 104 can be made of a flexible material, such that a user can apply pressure to the sides of the attachment member 104 and can thereby widen the attachment opening 106 such that a faucet 108 can pass through the attachment opening 106.

Figure 2:
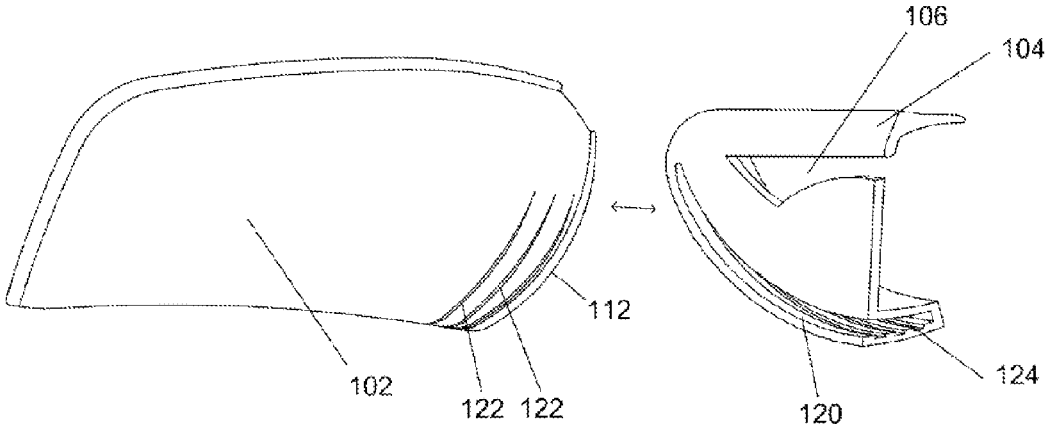
FIG. 2 depicts an exploded view a faucet attachment device, showing the underside of a trough member and a cross section of an attachment member.

FIG. 2 depicts the underside of the trough member 102 and a cross section of the attachment member 104. In some embodiments, the attachment member 104 can comprise a slit 120. The slit 120 can be formed in the shape of a transverse cross section of the trough member 102, such that the entrance 112 of the trough member 102 can slide into the slit 120 in the attachment member 104. The trough member 102 can comprise bumps or ridges 122 extending from the top or bottom sides of the entrance 112. The slit 120 can comprise depressions 124 along the inside of the slit 120. In operation, the entrance 112 of the trough member 102 can be inserted into the slit 120. The depressions 124 inside the slit 120 can engage the bumps or ridges 122 of the trough member 102. The interaction of the bumps or ridges 122 and the depressions 124 can create friction between the trough member 102 and the attachment member 104 and can keep the two members coupled. Alternatively, in some embodiments, the attachment member 104 can be permanently coupled with the trough member 102 via glue, adhesives, tape, cement, screws, bolts, rivets, anchors, clips, brads, staples, or any other known or desired affixing mechanism. In some embodiments, the attachment member 104 can be removably coupled with the trough member 102 by snaps, loops, hooks, clips, interlocking parts, pins, bands, screws, brads, buttons, or any other known or desired affixing mechanism. In still other embodiments, the attachment member 104 can be part of the same unitary body as the trough member 102, such that they are not separate components.

In operation, the embodiment of the faucet attachment device 100 depicted in FIG. 1 can engage a faucet 108 by passing the faucet 108 through the attachment opening 106 of the attachment member 104, such that the faucet 108 can be frictionally coupled with the attachment member 104. The attachment member 104 can be adjusted to engage the faucet 108 in such a position that the trough member 102 can be positioned below the faucet 108. When the faucet 108 is operated, water flowing from the faucet 108 can strike the trough member 102 at the entrance 112. The water can be diverted from its natural course to instead flow along the channel 110. The channel walls 116 118 can prevent the water from spilling over the edges of the channel 110. The water can leave the channel 110 at the exit 114 and flow along a course more easily accessible to a user.

Figure 3:
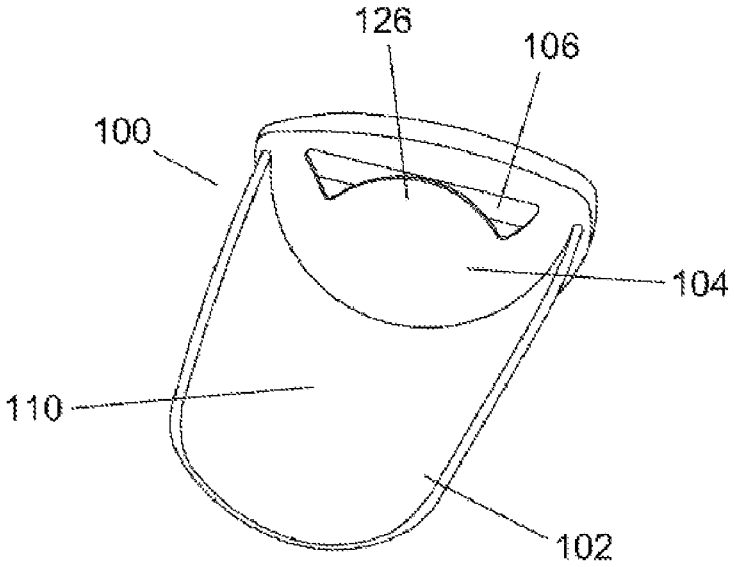
FIG. 3 depicts an embodiment of a faucet attachment device without a faucet.

FIG. 3 depicts the embodiment shown in FIG. 1 without a faucet. In the embodiment shown in FIG. 3, the attachment member 104 can comprise an extension piece 126 that extends into the attachment opening 106. The extension piece 126 can have a variety of sizes and shapes, and can extend into the attachment opening 126 from any desired direction or angle. The extension piece 126 can be used to provide additional support to the attachment member 104, to provide a tighter fit when the attachment opening 106 engages a faucet, to prevent water from spilling backwards along the channel 110 or behind the device, or for any other known or desired reason.

Figure 4:
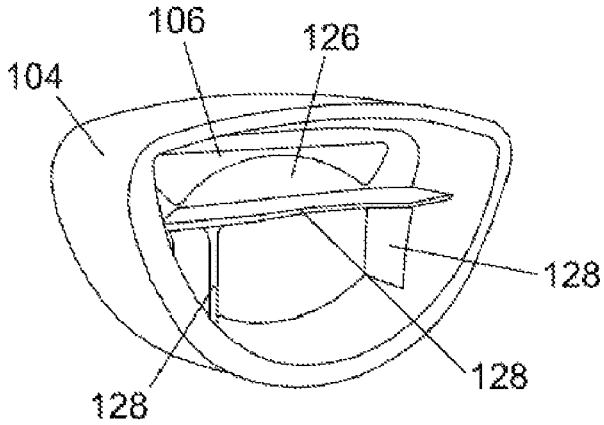
FIG. 4 depicts the back side of an embodiment of an attachment member.

FIG. 4 depicts the back side of an embodiment of the attachment member 104. In some embodiments, the attachment member 104 can comprise at least one structural support 128 coupled with the attachment member 104. The at least one structural support 128 can be housed within the attachment member 104, or coupled with any portion of the exterior of the attachment member 104. The at least one structural support 128 can be an extension, ridge, bar, pole, bump, or any other known support component. In some embodiments, the at least one structural support 128 can be made of the same material that the attachment member 104 comprises. In alternate embodiments, the at least one structural support 128 can be made of a harder or more rigid version of the same material that the attachment member 104 comprises. In still other embodiments, the at least one structural support 128 can be made of a different material or combination of materials than the attachment member 104 comprises, such as polypropylene, polyethylene, polyurethane, thermoplastic rubber, bamboo, recycled plastic, metal, or any other material or combination of materials that provides the desired strength, flexibility, durability, weight, water resistance, or other desired physical characteristic. In some embodiments, the at least one structural support 128 can be an extension of the attachment member 104 such that the structural support 128 and the attachment member 104 are one unitary body. By way of a non-limiting example, the at least one structural support 128 can be molded into the back side of the attachment member 104. In alternate embodiments, the at least one structural support 128 can be a separate component coupled with the attachment member 104 through adhesives, screws, snaps, interlocking parts, fitting the edges of the structural support 128 into holes or grooves within the attachment member 104, or any other known or desired affixing mechanism. In some embodiments, at least one structural support 128 can be coupled at an angle with at least one other structural support 128, at any point along any of the structural supports 128. By way of a non-limiting example, in the embodiment shown in FIG. 4, one structural support 128 is coupled with the attachment member 104 in a horizontal position below the attachment opening 106 and the extension piece 126, and two other structural supports 128 extend vertically downward from the horizontal support 128 to the bottom of the attachment member 104.

Figure 5:
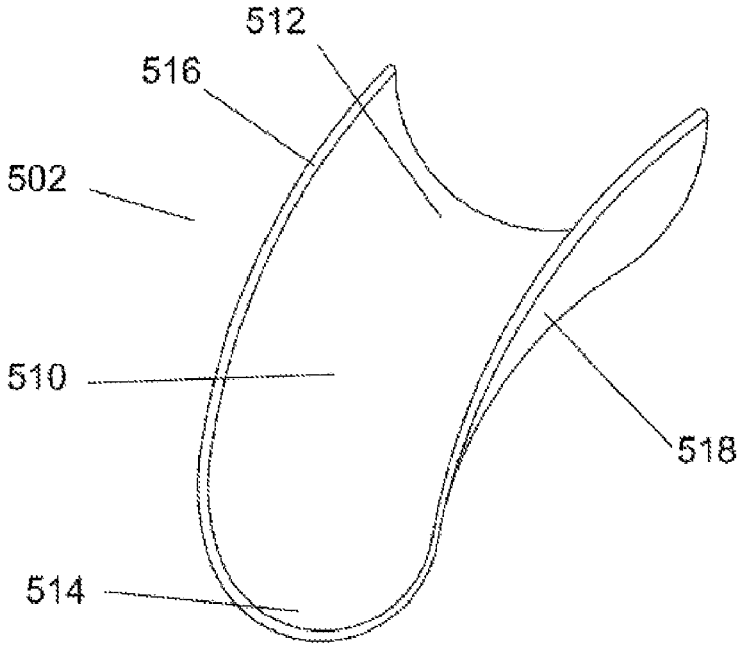
FIG. 5 depicts an embodiment of a trough member where one portion of the trough member is made from more flexible material than the rest of the trough member.

FIG. 5 depicts an embodiment of a trough member 502 in which one portion of the trough member 502 can be made from more flexible material than the rest of the trough member 502. The trough member 502 can be substantially similar to the trough member 102 shown in FIG. 1, and can comprise a channel 510, an entrance 512, an exit 514, and channel walls 516 518. The trough member 502 can have a variety of shapes and sizes. The trough member 502 can be made of polypropylene, polyethylene, polyurethane, thermoplastic rubber, bamboo, recycled plastic, metal, or any other material or combination of materials that provides the desired strength, flexibility, durability, weight, water resistance, or other desired physical characteristic. In some embodiments, the trough member 502 can be made of different materials with different flexibilities, such that some parts of the trough member 502 can have different flexibilities than other parts of the trough member 502. By way of a non-limiting example, in the embodiments shown in FIG. 5, the exit 514 can be made of a more flexible material than the rest of the trough member 502, such that the exit 514 can droop when liquid flows over it. In some embodiments, the channel 510 can be substantially linear from the entrance 512 to the exit 514. In alternate embodiments, the channel can droop, rise, swing left, swing right, have waves, have curves, have ridges, or have any other functional form known, convenient, or desired.

Figure 6:
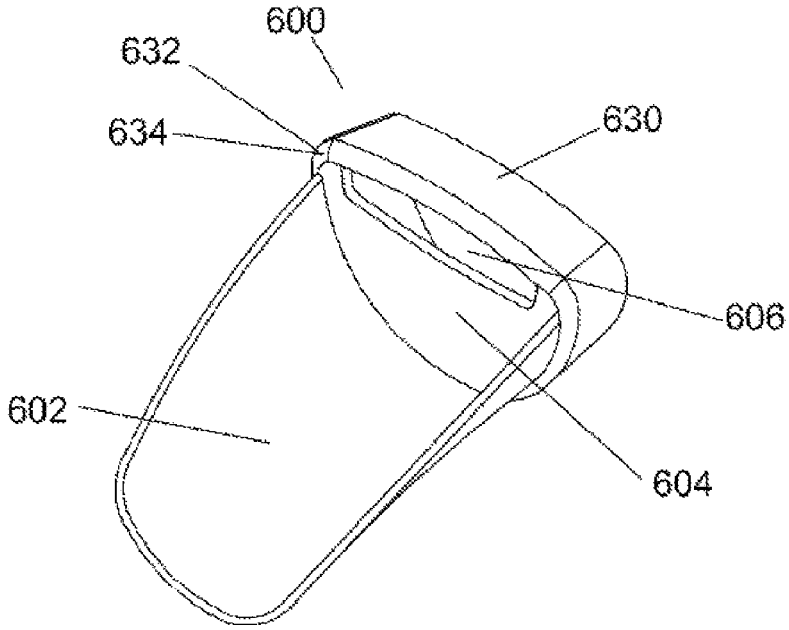
FIG. 6 depicts an alternate embodiment of a faucet attachment device.

FIG. 6 depicts an alternate embodiment of a faucet attachment device 600. The faucet attachment device 600 can comprise a trough member 602 coupled with an attachment member 604. The attachment member can comprise an attachment opening 606. The attachment member 604 can be one unitary component, or it can be coupled with a removable piece 630. In some embodiments, the removable piece 630 can be removably coupled with the attachment member 604 via snaps, loops, hooks, clips, interlocking parts, pins, bands, screws, brads, buttons, or any other known or desired attachment mechanism. In alternate embodiments, the removable piece 630 can be coupled with the attachment member 604 by a hinge 632 located at a connection point 634 or any other desired location. In some embodiments, the removable piece 630 can extend across a gap within the attachment member 604 such that the removable piece 630 can form a part of the edge of an attachment opening 606 when the removable piece 630 is coupled with the attachment member 604.

In operation, the removable piece 630 can be removed from the attachment member 604. In alternate embodiments, the removable piece can be rotated away from the attachment member 604 via a hinge 632 at connection point 532. The attachment member 604 can be positioned underneath a faucet arm, such that the trough member 602 is below the faucet. The removable piece 630 can be placed on top of the faucet arm and coupled with the attachment member 604 at connection point 634 via snaps, loops, hooks, clips, interlocking parts, pins, bands, screws, brads, buttons, or any other known or desired attachment mechanism.

Figure 7:
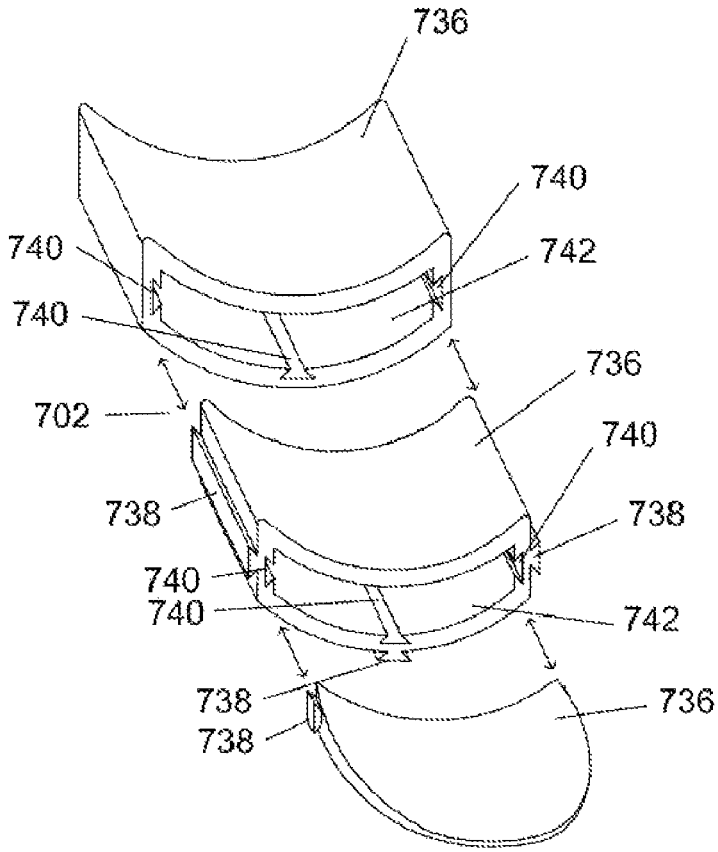
FIG. 7 depicts an embodiment of an extendable trough member

FIG. 7 depicts an embodiment of a trough member 702 that can be comprised of at least two trough pieces 736. In some embodiments, the at least two trough pieces 736 can interact with one another to extend the trough member 702 to a desired length. In alternate embodiments, the at least two trough pieces 736 can interact with one another to retract the trough member 702 to a desired length. In some embodiments, the at least two trough pieces 736 can interact with each other to extend or retract the trough member 702 to a preset intermediate length between a fully extended position and a fully retracted position, or to any desired intermediate length between a fully extended position and a fully refracted position. The at least two trough pieces 736 can comprise grooves 738 and groove inserts 740. The groove inserts 740 of one trough piece 736 can slide inside the grooves 738 of an adjacent trough piece 736. In some embodiments, the trough pieces 736 can comprise hollow cavities 742, such that one trough piece 736 can slide along the grooves 738 and retract into, or extend from, the hollow cavity 742 of an adjacent trough piece 736. In alternate embodiments, the at least two trough pieces 736 can interact by having trough pieces of different sizes engaged inside one another in a telescoping configuration, by interlocked sliding arms, or by any other known or desired extension or retraction method.

Figure 8:
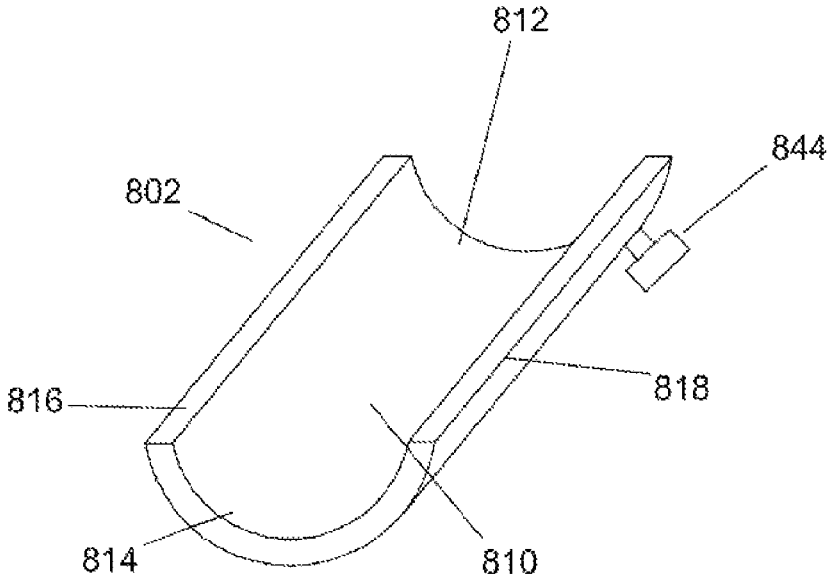
FIG. 8 depicts an embodiment of a trough member with protrusions.

FIG. 8 depicts an embodiment of a trough member 802. The trough member 802 can be substantially similar to the trough member 102 shown in FIG. 1, and can comprise a channel 810, an entrance 812, an exit 814, and channel walls 816 818. The trough member 802 can also comprise one or more protrusions 844. In the embodiment shown in FIG. 8, one or more protrusions 844 can be located on the outwardly facing sides of the channel walls 816 818. In alternate embodiments, one or more protrusions 844 may be located on the inwardly facing sides of the channel walls 816 818, at the tops of the channel walls 816 818, near the entrance 812, or at any other location desired on the trough member 802. The protrusions 844 can take a variety of forms, and can have a variety of shapes and sizes. In some embodiments, the protrusions 844 can be a button, resemble body parts such as ears, or take any other size or shape. The protrusions 844 can be made of polypropylene, polyethylene, polyurethane, thermoplastic rubber, bamboo, recycled plastic, metal, or any other material or combination of materials that provides the desired strength, flexibility, durability, weight, water resistance, or other desired physical characteristic. In some embodiments, the protrusions 844 can be more or less flexible than the rest of the overall structure.

Figure 9:
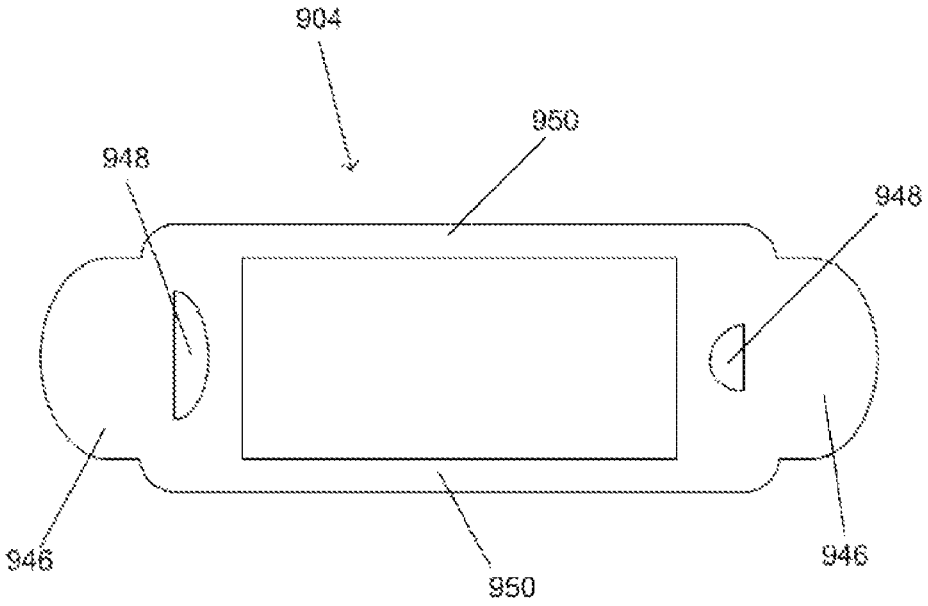
FIG. 9 depicts an embodiment of an attachment member.

FIG. 9 depicts an embodiment of an attachment member 904. The attachment member 904 can comprise at least one end portion 946, at least one open area 948, and at least one faucet interaction region 950. The open areas 948 can be apertures located within the end portions 946. In some embodiments, one end portion 946 can be connected to another end portion 946 by at least one faucet interaction region 950. In some embodiments, the end portions 946 can be removable from the faucet interaction regions 950. The at least one faucet interaction region 950 can be one or more straps, bands, or any other mechanism capable of interacting with a faucet. The end portions 946 and the faucet interaction regions 950 can be made of polypropylene, polyethylene, polyurethane, thermoplastic rubber, bamboo, recycled plastic, metal, or any other material or combination of materials that provides the desired strength, flexibility, durability, weight, water resistance, or other desired physical characteristic. The end portions 946 can be made of a different material than the faucet interaction regions 950. In some embodiments, the at least one faucet interaction region 950 can be made of a more flexible or stretchable material than the material used for the end portions 946.

In the embodiment shown in FIG. 9, two end portions 946 are connected by two faucet interaction regions 950. The open areas 948 can be configured to engage protrusions similar to the protrusions 844 shown in FIG. 8, thereby coupling the attachment member 904 to a trough member similar to the trough member 802 shown in FIG. 8. The open areas 948 can have a variety of sizes and shapes. In some embodiments, the open areas 948 can be circular, rectangular, triangular, semicircular, or have any other known or desired shape. In some embodiments, an open area 948 can be substantially the same size as a cross section of a protrusion 844 such that the open area 948 can engage the protrusion 844 snugly. In alternate embodiments, an open area 948 can be larger than the cross section of a protrusion 844, such that the open area 948 can be easily engaged around or removed from the protrusion 844. In some embodiments that have a plurality of open areas 948, the open areas 948 can be the same size and shape, or have different sizes or shapes as desired.

Figure 10:
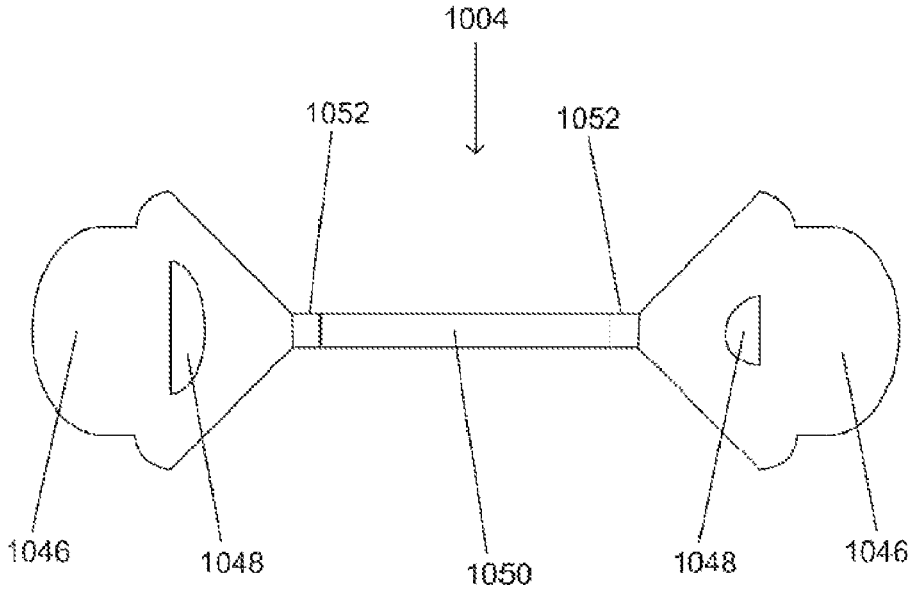
FIG. 10 depicts a top-down view of an embodiment of an attachment member.

FIG. 10 depicts a top-down view of an embodiment of an attachment member 1004. The attachment member 1004 can comprise two end portions 1046, an open area 1048 located within each end portion 1046, and at least one faucet interaction region 1050. The faucet interaction regions 1050 can be one or more straps, bands, or any other mechanism capable of interacting with a faucet. In the embodiment shown in FIG. 10, there can be more than one faucet interaction region 1050 located behind each other so that only one is visible from the top-down viewpoint shown. The end portions 1046 can be coupled with the at least one faucet interaction region 1050 at one or more joints 1052 located at each end of each faucet attachment region 1050. The joints 1052 can comprise a hinge, a ball and socket configuration, rotatably interlocking pieces, or any other mechanism that allows the end portions 1046 to rotate independently of the at least one faucet interaction region 1050 while remaining connected, such that the attachment member 1004 can have a tri-axial configuration. In operation, each end portion 1046 can be rotated to an angle suitable for the open area 1048 on the end portion 1046 to engage a protrusion such as protrusion 844 shown in FIG. 8. The at least one faucet interaction region 1050 can be rotated to an angle suitable for it to secure around a faucet. All three components can be oriented at different angles as needed. In some embodiments, the joint 1052 can lock the three components into position after they are rotated to the desired angles. The joint 1052 can lock the components into position by having a hinge with a pin, a clip, interlocking pieces that snap into place at certain angles, or any other known or desired mechanism for locking a joint.

Figure 11:
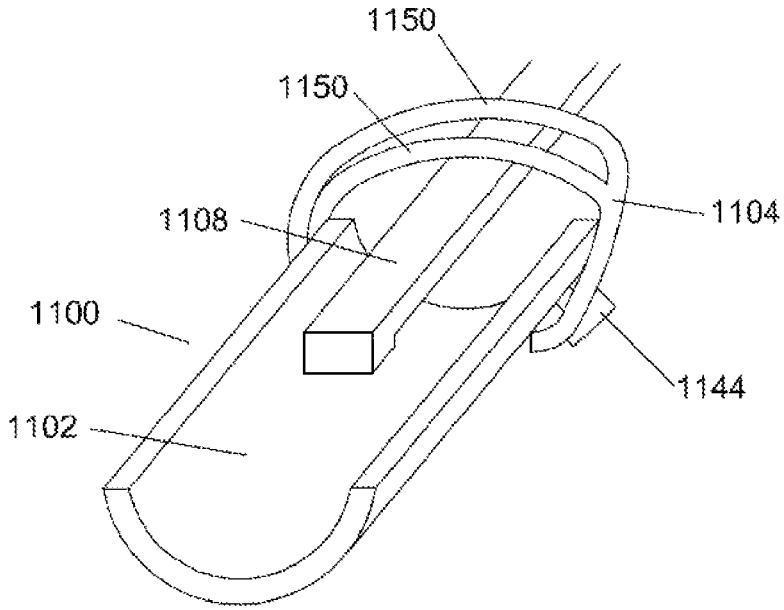
FIG. 11 depicts an embodiment of a faucet attachment device that is secured to a faucet.

FIG. 11 depicts an embodiment of a faucet attachment device 1100 that is secured to a faucet 1108. The faucet attachment device 1100 can comprise a trough member 1102 with at least one protrusion 1144, and an attachment member 1104 with at least one faucet interaction region 1150. In some embodiments, the faucet attachment device 1100 can be secured to the faucet 1108 by wrapping the at least one faucet interaction region 1150 above the faucet 1108 and connecting the attachment member 1104 to the at least one protrusion 1144 such that the trough member 1102 hangs below the faucet 1108.

Figure 12:
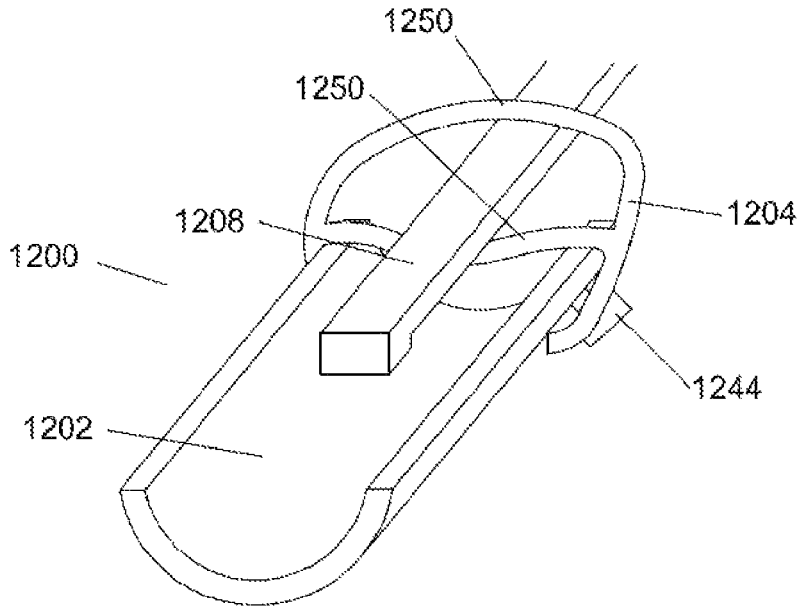
FIG. 12 depicts an alternate embodiment of a faucet attachment device that is secured to a faucet in an alternate way.

FIG. 12 depicts an alternate embodiment of a faucet attachment device 1200 that is secured to a faucet 1208 in a different way. The faucet attachment device 1200 can comprise a trough member 1202 with at least one protrusion 1244, and an attachment member 1204 with at least two faucet interaction regions 1250. In some embodiments, the faucet attachment device 1200 can be secured to the faucet 1208 by wrapping one of the faucet interaction regions 1250 above the faucet 1208, wrapping another one of the faucet interaction regions 1250 below the faucet 1208, and connecting the attachment member 1204 to the at least one protrusion 1244 such that the trough member 1202 hangs below the faucet 1208. In alternate embodiments, the at least one faucet interaction regions 1140 can be looped around the faucet 1208, spun to create a helix form that the faucet 1208 can pass through, or manipulated in any other fashion desirable to secure the overall faucet attachment device 1200 to a faucet 1208.

Figure 13:
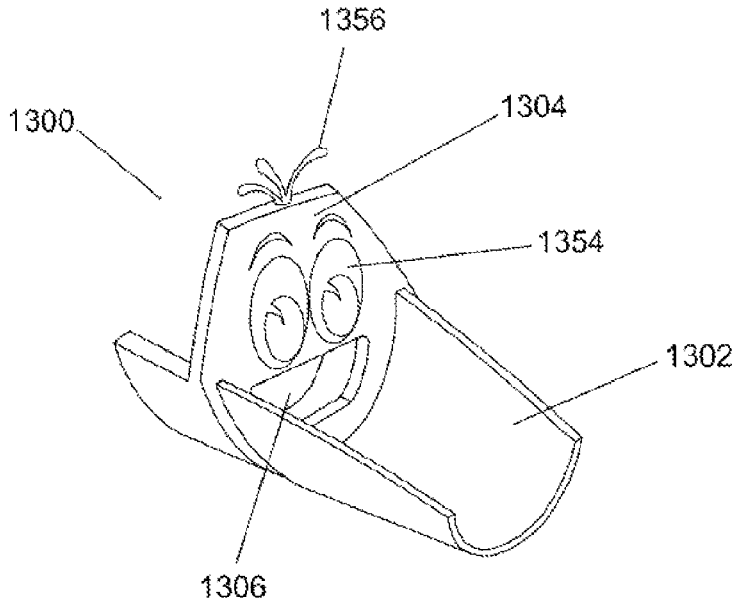
FIG. 13 depicts an embodiment of a faucet attachment device with decorative features.

FIG. 13 depicts an embodiment of a faucet attachment device 1300 having decorative features. The faucet attachment device 1300 can comprise a trough member 1302, an attachment member 1304, and an attachment opening 1306. In some embodiments, the decorative features can be permanently formed parts of the faucet attachment device 1300. In alternate embodiments, the decorative features can be removed from the faucet attachment device 1300 and interchanged with other decorative features as desired. In the embodiment shown in FIG. 13, the decorative features include eyes 1354 and feathers 1356 located on the attachment member 1304. In some embodiments, the attachment opening 1306 can be formed into the shape of a mouth, nose, or any other desirable feature. Some embodiments can include decorative features intended to make the faucet attachment device resemble an animal, such as a duck, cow, chicken, pig, or any other animal. Other embodiments can include decorative features intended make the faucet attachment device resemble cartoon characters, vehicles, plants, or any other desired design. In some embodiments, decorative features can include any other body part or facial characteristic, such as ears, noses, hair or any other desired characteristic. Decorative features are not limited to representations of facial features or body parts, and can include various color schemes, patterns, or any other desired design.

Figure 14:
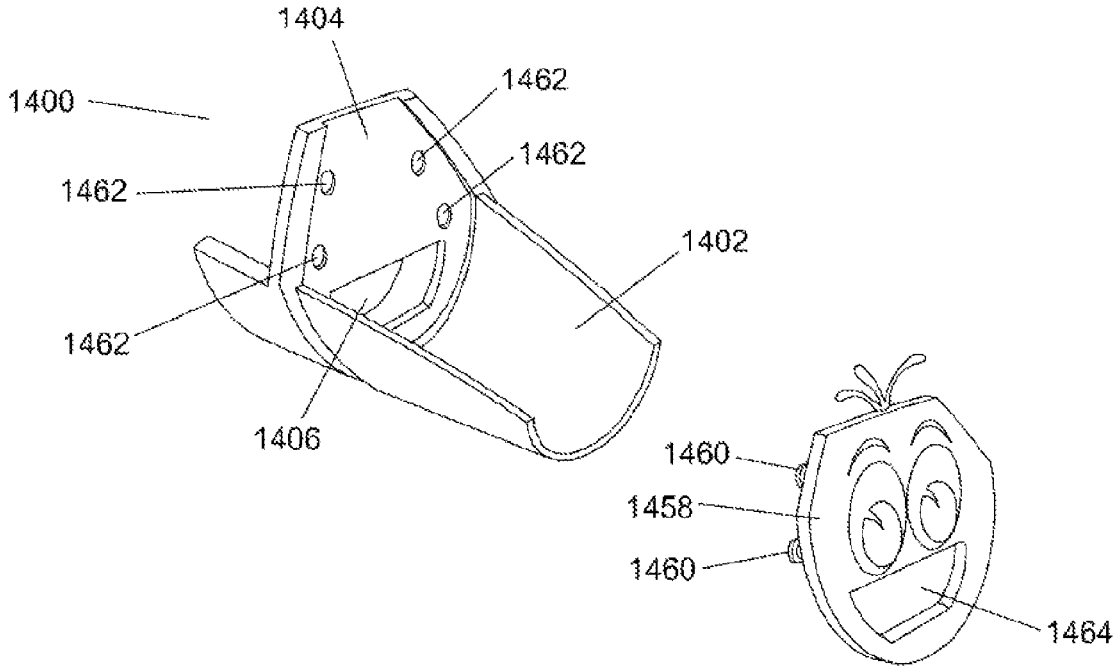
FIG. 14 depicts an embodiment of a faucet attachment device with a removable faceplate.

FIG. 14 depicts an embodiment of a faucet attachment device 1400 that can comprise a removable faceplate 1458. The faucet attachment device 1400 can be substantially the same as the faucet attachment device 1300 shown in FIG. 13, and can comprise a trough member 1402, an attachment member 1404, and an attachment opening 1406. The removable faceplate 1458 can be decorated with a design. Various embodiments of the removable faceplates 1458 can feature pictures of faces, pictures of scenery, graphic designs, artwork, or any other desirable design. In some embodiments, the removable faceplate 1458 can be coupled with the faucet attachment device 1400 by fitting connection components 1460 into corresponding holes 1462 in the attachment member 1404. In alternate embodiments, the removable faceplate 1458 can be coupled with the faucet attachment device 1400 by using snaps or hooks, sliding it into grooves within the trough member 1402, by placing it into a windowed pocket coupled to the faucet attachment device 1400, by attaching it to areas similar to the protrusions 724 shown in FIG. 8, or by any other known or desired attachment mechanism. The removable faceplate 1458 can comprise a faceplate opening 1464 that can correspond with the attachment opening 1406. In operation, a faucet arm can pass through both the attachment opening 1406 and the faceplate opening 1464. In some embodiments, the structure of the removable faceplate 1458 can provide support to the attachment member 1404 when the faucet attachment device 1400 is connected to a faucet.

Figure 15:
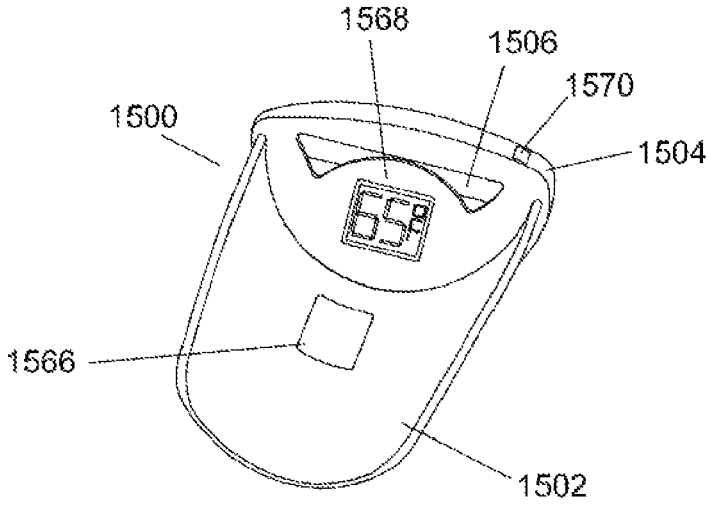
FIG. 15 depicts an embodiment of a faucet attachment device with a temperature sensor, a temperature display, and a power source.

FIG. 15 depicts an embodiment of a faucet attachment device 1500 that can comprise a temperature sensor 1566 and a temperature display 1568. The faucet attachment device 1500 can be substantially the same as the faucet attachment device 100 shown in FIG. 1, and can comprise a trough member 1502, an attachment member 1504, and an attachment opening 1506. The faucet attachment device 1500 can also comprise a power source 1570 configured to supply power to the temperature sensor 1566 and the temperature display 1568 in circuit. The power source 1570 can provide power to the temperature sensor 1566 and the temperature display 1568. The power source 1570 can be a battery, a generator, a hydroelectric generator, a plug attached to an electrical outlet, or any other known or desired mechanism for providing power to a circuit. In some embodiments, the power source can comprise a switch to turn the power source on or off.

The temperature sensor 1566 can be located on or within the trough member 1502, or anywhere else on the faucet attachment device 1500. The temperature sensor 1566 can be a thermistor, thermocouple, resistive thermal device, or any other known or desired temperature sensor. The temperature display 1568 can be in the form of an LCD screen, LED lights, or any other known or desired display. In operation, the temperature sensor 1566 can measure the temperature of the water flowing down the channel of the trough member 1502, and the water's temperature can be displayed to the user on the temperature display 1568. In various embodiments the temperature can be displayed in terms of Fahrenheit or Celsius degrees, icons or colors indicating that the water is generally hot or cold, or any other known or desired method of indicating a temperature. The temperature display 1568 can be located anywhere on the faucet attachment device 1500. In some embodiments, the temperature display 1568 can be integrated with decorative features that can be present on the device. For example, the eyes 1354 shown in FIG. 13 can include LED lights that glow red when the water is hot and green when the water is cold, thereby indicating when the water flowing from the device is safe for a user to touch. In alternate embodiments, the faucet attachment device 1500 may not have a temperature display 1568 that operates visually, but can indicate the water temperature to the user by broadcasting audio signals through a speaker, or through any other known or desired mechanism for indicating information. In still other embodiments, the temperature sensor 1566 can comprise a heat-sensitive material that changes color or appearance when exposed to heat, such that the temperature sensor 1566 can indicate a temperature to a user directly without a separate temperature display or a power source. The heat-sensitive material can be a thermochromatic or thermochromic coating, such as an ink, a paint, or a dye, applied to all or a portion of the trough member 1502, a thermal paper, a thermochromic polymer, or any other known material that changes appearance when exposed to heat.

Figure 16:
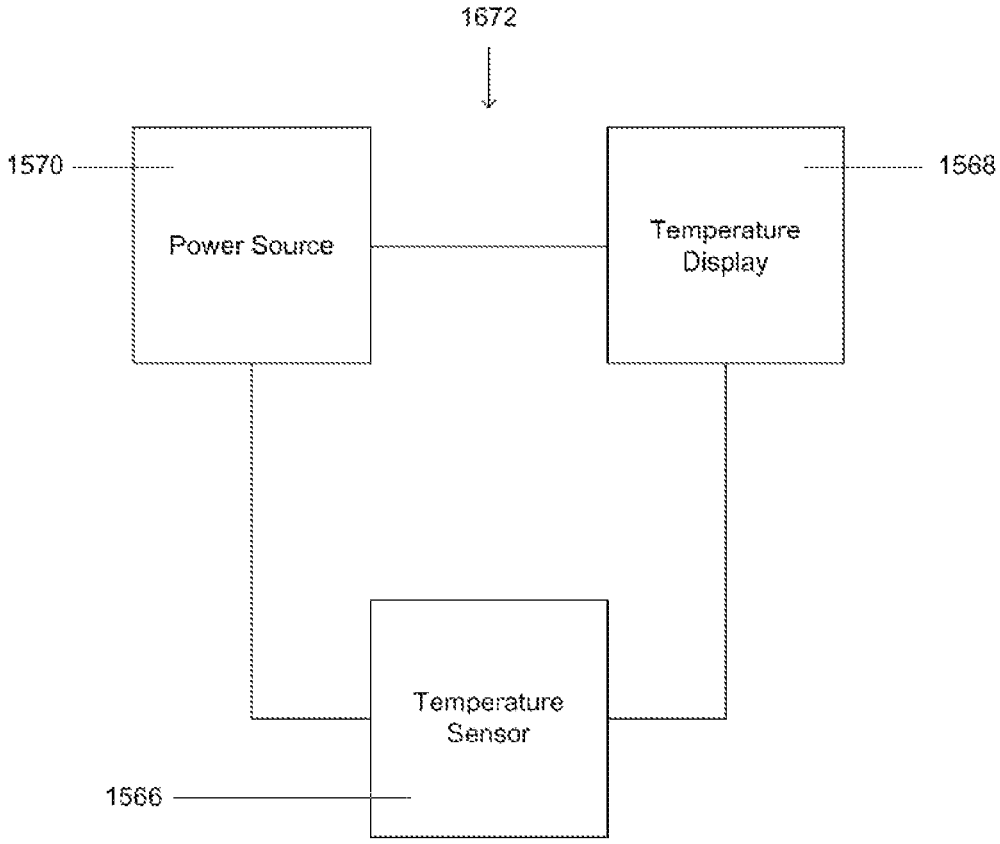
FIG. 16 depicts a circuit with a temperature sensor, a temperature display, and a power source.

FIG. 16 depicts a circuit 1672 comprising the power source 1570 coupled with the temperature sensor 1566 and the temperature display 1568 shown in FIG. 15. The circuit 1672 can transmit power between the components. In some embodiments, the circuit 1672 can transmit signals between the components. In some embodiments, the signals can include data transmissions, such as data transmissions regarding the temperature measured by the temperature sensor, the power level within the circuit, whether to display temperature in Fahrenheit or Celsius degrees, or any other type of data desired.

In the foregoing specification, the invention has been described with reference to specific exemplary embodiments thereof It will, however, be evident that various modifications and changes may be made thereto without departing from the broader spirit and scope of the invention. The specification and drawings are, accordingly, to be regarded in an illustrative sense rather than a restrictive sense.

What is claimed is:

1. A faucet extender, comprising:

an attachment member comprising a unitary body defining a faucet connection aperture, wherein the faucet connection aperture is a closed form slit-like opening entirely enclosed by portions of the unitary body, the unitary body comprising a flexible material that is configured to flexibly and frictionally engage a top and bottom portion of a faucet when the faucet is extended through said faucet connection aperture, and wherein the unitary body includes a structural support located adjacent a curved extension piece, wherein the curved extension piece is disposed in the lower portion of the unitary body directly underneath the faucet connection aperture, wherein the curved extension piece is configured to (i) define at least a lower portion of the closed form slit-like opening and (ii) contact a bottom portion of the faucet when the faucet is engaged with the unitary body; and a partially open trough member comprising an entrance and an exit;

wherein the edge of said entrance is coupled with said attachment member, when said portion of the faucet extends through said faucet connection aperture, the attachment member is oriented such that water flowing from said faucet enters said partially open trough member, and the partially open trough member (i) laterally and forwardly extends beyond a forward face of the faucet and (ii) has lateral sidewalls that taper downwardly from the entrance to the exit with the lateral sidewalls having greater height at the entrance than at the exit.

2. The faucet extender of claim 1, wherein the perimeter of said faucet connection aperture is entirely defined by said unitary body.

3. The faucet extender of claim 1, wherein said partially open trough member is oriented such that water in said partially open trough member exits said partially open trough member at said exit.

4. The faucet extender of claim 1, wherein said unitary body is configured to removably engage from the portion of the faucet.

5. The faucet extender of claim 1, wherein the entirety of the edge of said entrance is coupled with said attachment member.

6. The faucet extender of claim 1, wherein said entrance is wider than said exit.

7. The faucet extender of claim 1, wherein said partially open trough member is substantially "U" shaped at every cross section transverse to an axis extending from said entrance to said exit.

8. The faucet extender of claim 1, wherein a first portion of said faucet connection aperture is oriented at a different angle than a second portion of said faucet connection aperture.

9. The faucet extender of claim 1, wherein the width of said faucet connection aperture is greater than the height of said faucet connection aperture.

10. The faucet extender of claim 1, wherein said attachment member and said partially open trough member are each part of an integrated body.

11. The faucet extender of claim 1, wherein said attachment member is made of polypropylene, polyethylene, polyurethane, thermoplastic rubber or recycled plastic.

12. A faucet extender, comprising:

an attachment member comprising a unitary body defining a faucet connection aperture, wherein the faucet connection aperture is a closed form slit-like opening entirely enclosed by portions of the unitary body, the unitary body comprising a flexible material that is configured to flexibly and frictionally engage a top and bottom portion of a faucet when the faucet is extended through said faucet connection aperture, and wherein the unitary body includes a structural support located adjacent a curved extension piece, wherein the curved extension piece is disposed in the lower portion of the unitary body directly underneath the faucet connection aperture wherein the curved extension piece is configured to (i) define at least a lower portion of the closed form slit-like open and (ii) contact a bottom portion of the faucet when the faucet is engaged with the unitary body; and a partially open trough member comprising an entrance and an exit; wherein the edge of said entrance is selectively coupled with said attachment member, when said portion of the faucet extends through said faucet connection aperture, the attachment member is oriented such that water flowing from said faucet enters said partially open trough member, and the partially open trough member (i) laterally and forwardly extends beyond a forward face of the faucet and (ii) has lateral sidewalls that taper downwardly from the entrance to the exit with the lateral sidewalls having greater height at the entrance than at the exit.

13. The faucet extender of claim 12, wherein the perimeter of said faucet connection aperture is entirely defined by said unitary body.

14. The faucet extender of claim 12, wherein said partially open trough member is oriented such that water in said partially open trough member exits said partially open trough member at said exit.

15. The faucet extender of claim 12, wherein said attachment member is made of polypropylene, polyethylene, polyurethane, thermoplastic rubber or recycled plastic.

* * * * *